US009121185B2

(12) United States Patent
Grenier

(10) Patent No.: US 9,121,185 B2
(45) Date of Patent: Sep. 1, 2015

(54) PREFABRICATED STAIRCASE AND FINISHING ARRANGEMENT AND INSTALLATION METHOD THEREFOR

(71) Applicant: Gilles Grenier, St-Elzéar (CA)

(72) Inventor: Gilles Grenier, St-Elzéar (CA)

( * ) Notice: Subject to any disclaimer, the term of this patent is extended or adjusted under 35 U.S.C. 154(b) by 0 days.

(21) Appl. No.: 13/921,768

(22) Filed: Jun. 19, 2013

(65) Prior Publication Data

US 2014/0373462 A1 Dec. 25, 2014

Related U.S. Application Data

(63) Continuation-in-part of application No. 12/801,643, filed on Jun. 18, 2010, now abandoned.

(60) Provisional application No. 61/344,060, filed on May 17, 2010, provisional application No. 61/213,560, filed on Jun. 19, 2009.

(51) Int. Cl.

| | |
|---|---|
| ***E04F 11/17*** | (2006.01) |
| ***E04F 11/108*** | (2006.01) |
| *E04F 11/025* | (2006.01) |
| *E04F 11/02* | (2006.01) |

(52) U.S. Cl.

CPC ..... *E04F 11/17* (2013.01); *E04F 11/108* (2013.01); *E04F 11/025* (2013.01); *E04F 2011/0207* (2013.01)

(58) Field of Classification Search

CPC ..... E04F 11/16; E04F 11/17; E04F 11/025; E04F 11/108; E04F 11/035; E04F 11/163; E04F 2011/0207; E04F 2011/0205

USPC ..... 52/182, 188, 191

See application file for complete search history.

(56) References Cited

U.S. PATENT DOCUMENTS

| | | | | | |
|---|---|---|---|---|---|
| 184,013 | A | * | 11/1876 | Krickl | 52/179 |
| 256,336 | A | * | 4/1882 | Lawrence | 52/177 |
| 307,551 | A | * | 11/1884 | Jackson | 52/188 |
| 381,407 | A | * | 4/1888 | Momberg | 52/188 |
| 448,566 | A | * | 3/1891 | Williams | 52/188 |
| 569,464 | A | * | 10/1896 | Moore | 52/188 |
| 606,532 | A | * | 6/1898 | Furness | 52/179 |
| 1,475,777 | A | * | 11/1923 | Ballenger | 52/189 |
| 1,674,713 | A | * | 6/1928 | Brooks | 52/179 |
| 1,812,504 | A | * | 6/1931 | Del Turco | 52/188 |
| 2,021,457 | A | * | 11/1935 | Mackenzie | 52/191 |
| 2,696,027 | A | * | 12/1954 | Ryland | 52/182 |
| 2,827,675 | A | * | 3/1958 | Nelson | 52/179 |
| 2,881,485 | A | * | 4/1959 | Hyman | 52/179 |
| 3,287,867 | A | * | 11/1966 | Aton | 52/179 |
| 3,393,481 | A | * | 7/1968 | Meuret | 52/188 |
| 3,612,472 | A | * | 10/1971 | Steigerwaldt, Jr. | 249/208 |
| 3,788,018 | A | * | 1/1974 | Simmons et al. | 52/185 |
| 3,859,771 | A | * | 1/1975 | Simmons et al. | 52/741.2 |
| 4,275,972 | A | * | 6/1981 | Bowen et al. | 403/401 |
| 4,583,335 | A | * | 4/1986 | Morellini | 52/182 |
| 4,783,939 | A | * | 11/1988 | Bergmann et al. | 52/188 |

(Continued)

*Primary Examiner* — James Ference

(74) *Attorney, Agent, or Firm* — Equinox IP; Franz Bonsang, Patent Agent

(57) ABSTRACT

A staircase of skeletal form is prefabricated and is provided with prefabricated decorative cladding finishing plates for the treads, the risers and the stringer boards, the plates being pre-drilled for ease of assembly, a plurality of finishing plates can be preassembled, or factory assembled, together before installation over a portion of the prefabricated staircase, and the installation method thereof.

2 Claims, 6 Drawing Sheets

(56) References Cited

U.S. PATENT DOCUMENTS

| | | | | | |
|---|---|---|---|---|---|
| 5,090,835 | A * | 2/1992 | Cox | 403/294 |
| 5,163,491 | A * | 11/1992 | Smith | 144/353 |
| 5,205,093 | A * | 4/1993 | Schuette | 52/182 |
| 5,347,774 | A * | 9/1994 | Smith | 52/182 |
| 5,402,610 | A * | 4/1995 | Salva' et al. | 52/182 |
| 5,502,933 | A * | 4/1996 | Skillern | 52/182 |
| 5,531,048 | A * | 7/1996 | Darling | 52/188 |
| 5,613,341 | A * | 3/1997 | Skillern | 52/741.2 |
| 5,720,136 | A * | 2/1998 | Turner | 52/182 |
| 5,806,253 | A * | 9/1998 | Nelson | 52/179 |
| 5,806,254 | A * | 9/1998 | Bennett | 52/182 |
| 5,907,935 | A * | 6/1999 | Elena | 52/182 |
| 6,029,408 | A * | 2/2000 | Cavaness | 52/188 |
| 6,067,758 | A * | 5/2000 | Zenkner | 52/182 |
| 6,088,977 | A * | 7/2000 | Lawrence | 52/182 |
| 6,112,480 | A * | 9/2000 | Turner | 52/182 |
| 6,115,975 | A * | 9/2000 | Abdollahi | 52/179 |
| 6,125,598 | A * | 10/2000 | Lanphier | 52/182 |
| 6,354,403 | B1 * | 3/2002 | Truckner et al. | 182/228.1 |
| 6,397,529 | B1 * | 6/2002 | Grenier | 52/182 |
| 6,516,574 | B1 * | 2/2003 | Couture | 52/182 |
| 7,464,505 | B2 * | 12/2008 | Grenier | 52/179 |
| 7,469,516 | B2 * | 12/2008 | Smith | 52/741.2 |
| 2002/0088669 | A1 * | 7/2002 | Truckner et al. | 182/228.1 |
| 2003/0093959 | A1 * | 5/2003 | Couture | 52/182 |
| 2004/0040229 | A1 * | 3/2004 | Torch | 52/189 |
| 2005/0160688 | A1 * | 7/2005 | Truckner et al. | 52/182 |
| 2006/0150539 | A1 * | 7/2006 | Vanhastel et al. | 52/179 |
| 2006/0156649 | A1 * | 7/2006 | Smith | 52/182 |
| 2006/0196129 | A1 * | 9/2006 | Lin | 52/188 |
| 2006/0230693 | A1 * | 10/2006 | Giordano | 52/182 |
| 2006/0260224 | A1 * | 11/2006 | Grenier | 52/182 |
| 2007/0022697 | A1 * | 2/2007 | Barry et al. | 52/654.1 |
| 2007/0144084 | A1 * | 6/2007 | Barry et al. | 52/187 |
| 2008/0216421 | A1 * | 9/2008 | Chung et al. | 52/179 |
| 2008/0216422 | A1 * | 9/2008 | Chung et al. | 52/188 |
| 2009/0056245 | A1 * | 3/2009 | Miller | 52/188 |
| 2009/0277104 | A1 * | 11/2009 | McCool | 52/179 |
| 2010/0132277 | A1 * | 6/2010 | Bush | 52/182 |
| 2010/0319278 | A1 * | 12/2010 | Grenier | 52/182 |

* cited by examiner

PREFABRICATED STAIRCASE AND FINISHING ARRANGEMENT AND INSTALLATION METHOD THEREFOR

CROSS REFERENCE TO RELATED APPLICATIONS

The present application is a Continuation-In-Part (CIP) patent application of parent application Ser. No. 12/801,643 filed on Jun. 18, 2010 and published on Dec. 23, 2010 under publication No. U.S. 2010/0319278 A1, which claimed benefit of U.S. Provisional Application for Patent Ser. No. 61/213,560 filed on Jun. 19, 2009, and of U.S. Provisional Application for Patent Ser. No. 61/344,060 filed on May 17, 2010, all three of which being incorporated herein by reference.

FIELD OF THE INVENTION

The present invention concerns a prefabricated staircase and finishing plate arrangement therefore and method for installing same.

BACKGROUND OF THE INVENTION

It is well known in the art to provide finishing plates of finished wood or other material for unfinished treads, risers, and/or stringers of an unfinished staircase frame. Typically, the plates are installed after the unfinished staircase frame has been installed in the building. In general, for each tread and riser, the tread is measured by a workman and a corresponding finished tread plate and riser plate is cut, fitted and then secured to the tread and riser of the frame. Similarly, a finished stringer plate may be measured, cut, and fitted to one or more stringers, whether uncovered stringers which face openly into a surrounding room or wall stringers extending adjacent a wall.

Unfortunately, for such conventional staircases and finishing plates, the measuring, cutting, and fitting of the finishing plates must often be performed by workmen on-site at the building and require skilled workmen to ensure a nice finish, especially at the intersection corner between riser plates and a staircase open side stringer plate. Accordingly, installation is labour intensive and, therefore, costly. Additionally, as the sizing and fitting of the plates may involve substantial manual cutting of the plates on site, there is a risk of error in cutting and sizing, which may further increase costs. Finally, the cutting, sizing, and fitting of the plates on site in the building further increases risk of damage to the plates.

Accordingly, there is a need for an improved prefabricated staircase and finishing plate arrangement therefore and method of installation therefore.

SUMMARY OF THE INVENTION

It is therefore a general object of the present invention to provide an improved prefabricated staircase and finishing plate arrangement therefore and method of installation therefore.

An advantage of the present invention is that the staircase and finishing plates therefore are prefabricated, thus reducing manual labour required for cutting and fixing the staircase frame and the finishing plates.

Another advantage of the present invention is that the staircase frame and plates are easily installed, with a minimum of tools.

Another advantage of the present invention is that the plates are pre-sized to the correct size and shape for fitting to the prefabricated staircase frame, thus reducing risk of errors and damage.

Still another advantage of the present invention is that the staircase frame and plates may be installed in less time than for conventional plates and staircases.

A further advantage of the present invention is that the finishing plate arrangement for covering a plurality of adjacent steps of a prefabricated staircase frame can be preassembled, or factory assembled, to improve assembly quality and reduce cost thereof, since the dimensions of the prefabricated staircase frame are well known.

In a first aspect, the present invention provides a staircase finishing kit for installation over at least a portion of a prefabricated staircase frame having a plurality of vertical risers, a plurality of horizontal treads, the frame being connectable at opposing frame ends to first and second floor structures of a building with the frame extending between said first and second floor structures, the kit comprising:

at least one prefabricated finished stringer plate having, for each tread of said plurality of horizontal treads, a respective horizontal plate edge for horizontal alignment with each tread of said plurality of horizontal treads, and for each riser of said plurality of vertical risers, a respective vertical plate edge for vertical alignment with each riser of said plurality of vertical risers;

for each riser of said plurality of vertical risers, a respective prefabricated finished riser plate connectable to the at least one stringer plate to cover a respective riser of said plurality of vertical risers, each said respective prefabricated finished riser plate having a top vertical plate edge for vertical alignment with an adjacent tread of said plurality of horizontal treads and a respective said horizontal plate edge and intersecting an adjacent said respective vertical plate edge; and for each tread of said plurality of horizontal treads, a prefabricated finished tread plate having a decorative nosing extending along at least a front edge thereof and having a lip for abutment against an adjacent riser of said plurality of vertical risers, the tread plate being connectable to the at least one stringer plate by intersecting an adjacent said horizontal plate edge and to an adjacent said riser plate with the tread plate abuttingly covering a respective tread of said plurality of horizontal treads.

Conveniently, the prefabricated staircase frame further has at least one stringer board to which each riser of said plurality of vertical risers and each tread of said plurality of horizontal treads is connected, and wherein at least one said vertical plate edge from at least one said stringer plate is longitudinally mitred for intersection with a mitred lateral edge of a respective said riser plate to form a riser corner therewith. Each vertical plate edge and corresponding said lateral edge have respective slots extending at least partially therealong for alignment with one another, said respective slots simultaneously receiving a securing member, said securing member, preferably a securing nail or a Chinese nail, frictionally securing the riser plate to the stringer plate.

Conveniently, each horizontal plate edge of said plurality of stringer plates extends inwardly from a superjacent vertical plate edge to allow the respective tread plate to intersect said superjacent vertical plate edge and have the respective tread plate locally sandwiched between the stringer plate and the corresponding superjacent riser plate.

In one embodiment, the prefabricated staircase further comprises a plurality of steps, and the kit is factory assembled and covers said plurality of steps.

Another aspect of the invention comprises the prefabricated staircase frame in addition to staircase finishing kit in accordance with the first aspect of the invention.

Conveniently, the decorative nosing includes a plurality of spaced apart spike members extending horizontally inwardly beneath the tread plate from the lip, the tread plate being connectable to an adjacent riser of said plurality of vertical risers with the tread plate abuttingly covering the tread of said plurality of horizontal treads by insertion of the spike members through the adjacent riser plate and into the adjacent riser of said plurality of vertical risers with the lip abutting against the adjacent riser of said plurality of vertical risers.

In a further aspect of the present invention, there is provided a staircase comprising:

a prefabricated staircase frame having at least one vertical riser, at least one horizontal tread, and at least one stringer board connected to said at least one horizontal tread and said and at least one stringer board, the frame connected at opposing frame ends to first and second floor structures of a building with the frame extending between first and second floor structures;

at least one prefabricated finished stringer plate having, for each said at least one tread, a respective horizontal plate edge, and for each said at least one riser, a respective vertical plate edge, said at least one stringer plate connected to said at least one stringer board abuttingly covering said at least one stringer board with each respective said horizontal plate edge in horizontal alignment with said at least one tread and with each respective said vertical plate edge in vertical alignment with the respective said at least one riser;

for each said at least one riser, a respective prefabricated finished riser plate connected to said at least one riser to cover said at least one riser with a top vertical plate edge of said respective riser plate in vertical alignment with an adjacent said at least one tread and the respective horizontal plate edge and intersecting an adjacent said respective vertical plate edge to form a riser corner therewith; and for each said at least one tread, a prefabricated finished tread plate having a decorative nosing extending along at least a front edge thereof, the tread plate connected to an adjacent said at least one riser with the tread plate abuttingly covering said at least one tread by abutment against an adjacent said riser plate with a lip of the nosing.

Conveniently, each said vertical plate edge from at least one said stringer plate is longitudinally mitred and connected with a mitred lateral edge of a respective said riser plate, and preferably, at least one said vertical plate edge and a corresponding said lateral edge have respective slots extending at least partially therealong and in alignment with one another, said respective slots simultaneously receiving a securing member, said securing member frictionally securing the riser plate to said at least one stringer plate.

In yet another aspect of the present invention, there is provided a method for installing a prefabricated staircase, the method comprising the steps of:

connecting generally opposed frame ends of a prefabricated staircase frame to first and second floor structures of a building with the frame extending between the first and second floor structures, the frame having at least one vertical riser, at least one horizontal tread, and at least one stringer board to which each said at least one vertical riser and each said at least one vertical tread are connected, the frame connected at said opposing frame ends to the first and second floor structures;

after connecting the generally opposed frame ends, connecting at least one preassembled finishing plate arrangement to at least a portion of the prefabricated staircase frame using a securing means.

Conveniently, the at least one preassembled finishing plate arrangement includes at least one prefabricated finished stringer plate, at least one prefabricated finished riser plate and at least one prefabricated finished tread plate, the step of connecting the at least one preassembled finishing plate arrangement includes:

after connecting the generally opposed frame ends, for each stringer board, connecting a respective prefabricated finished stringer plate therefore to the stringer board to cover the stringer board with, for each said tread, a respective horizontal plate edge of the stringer plate in horizontal alignment with the tread, and, for each said riser, a respective vertical plate edge in vertical alignment with the riser;

after connecting each stringer plate, for each said riser, connecting a respective prefabricated finished riser plate to abuttingly cover the riser with a top horizontal edge of the riser plate in horizontal alignment with an adjacent said tread and the respective horizontal plate edge and intersecting an adjacent said vertical plate edge; and after connecting a respective prefabricated riser plate, for each said tread, connecting a prefabricated finished tread plate, having a decorative nosing forming at least a front edge thereof, to an adjacent said riser with the tread plate abuttingly covering the tread by abutment against the adjacent said riser plate with a lip of the nosing and with side edges of the tread plate in alignment with the horizontal plate edge.

Conveniently, the decorative nosing includes a plurality of spaced apart spike members extending horizontally inwardly beneath the tread plate from the lip thereof, and wherein the step of connecting a prefabricated finished tread plate includes connecting a prefabricated finished tread plate to an adjacent riser with the tread plate abuttingly covering the tread by insertion of the spike members through the adjacent riser plate and into the adjacent riser with the lip abutting against the adjacent riser.

In one embodiment, at least one said vertical plate edge from at least one said stringer plate is longitudinally mitred for intersection with a mitred lateral edge of a respective said riser plates to form a riser corner therewith, and said mitred vertical plate edge and said mitred lateral edge have respective slots extending at least partially therealong and in register with one another, and wherein the step of connecting a respective prefabricated finished riser plate includes securing the riser plate to the stringer plate by slidably and simultaneously inserting a securing member into said mitred vertical plate edge and corresponding said mitred lateral edge.

The or each prefabricated finished stringer plate is provided with preformed registration points for matching with corresponding positioned registration points on a corresponding stringer board of the prefabricated staircase frame, respective said stringer plate registration points are connected to respective said stringer board registration points with securing fixtures for alignment and securement of the stringer plate to the stringer board. For example, dowel holes may be predrilled in both the plate and the board and dowels are used in the aligned holes to connect the plate to the board.

Additional fixtures may be applied to secure the finishing stringer plate to the staircase and in particular may be in the form of angled screws extending from the treads through the stringer board and thence into the stringer plate when in cladding position in relation thereto. As will be appreciated, the pocket holes for the screws will be predrilled and accurately positioned for correct fastening into the stringer plate without piercing its decorative surface. In the prefabrication of the staircase, jigs will typically be used to generate the fixing holes so that standardized dimensional interrelationships between the various elements of the staircase can be established to facilitate assembly.

Further fixtures may be provided at the mitred juncture between the stringer plate and the final finishing riser plate at the foot of the staircase. Such fixtures may be in the form of Chinese nails, inserted vertically along the edges and the slots, extending between the plates within aligned registration slots at the mitre.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 2:
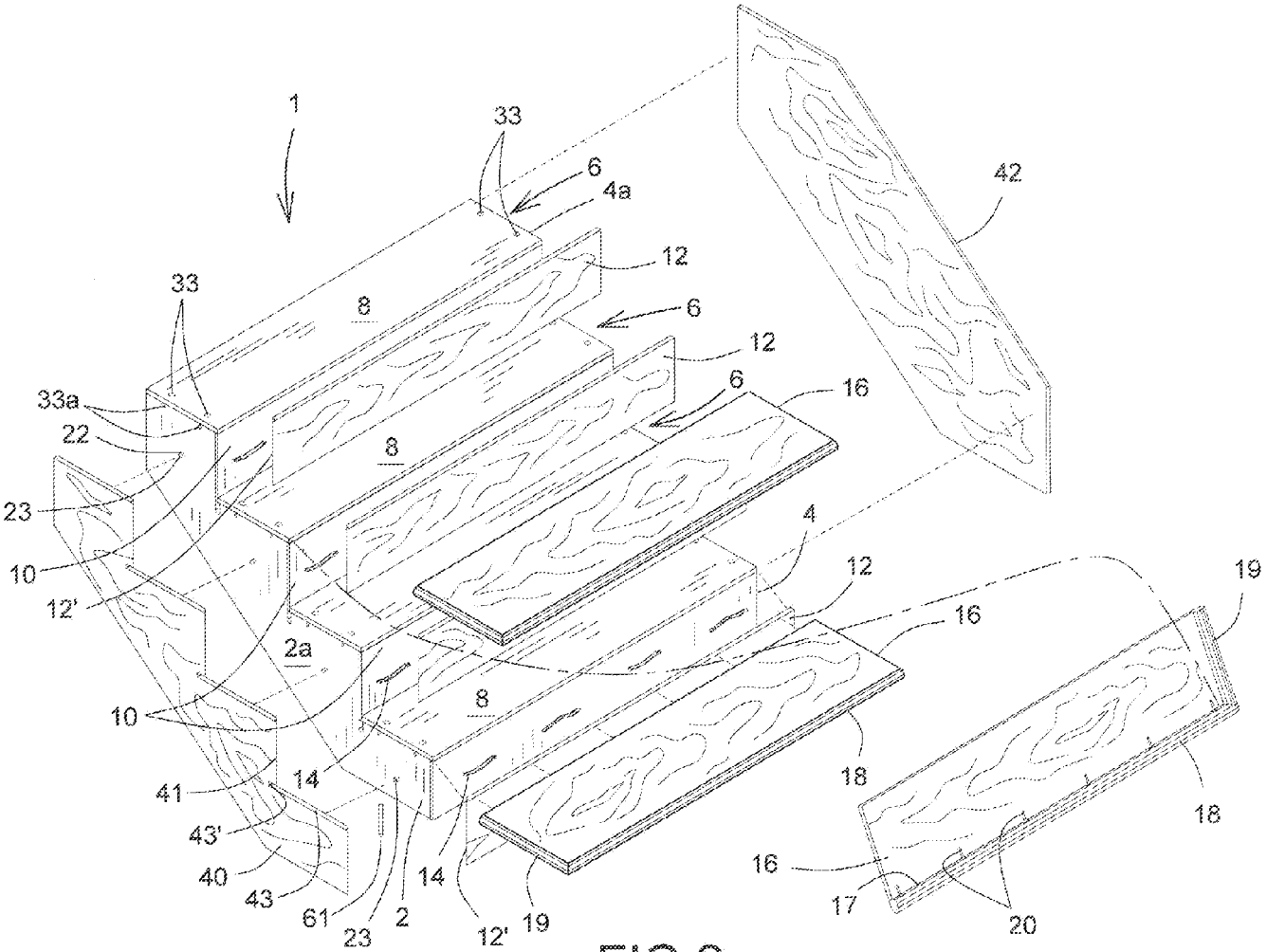
FIG. 2 is a top perspective view similar to FIG. 1, showing the staircase of FIG. 1 with the finishing plate arrangement shown in exploded view above the prefabricated staircase frame.

Referring first to FIG. 2, there is shown a prefabricated staircase 1 in skeletal form, and generally accurate in dimensions, comprising two spaced-apart stringer boards 2, 4 formed to provide the bases for four steps 6. Each step 6 comprises in known manner a tread 8 with a riser 10 in orthogonal horizontal and vertical disposition in relation to one another respectively, each tread having a leading edge covering the top edge of its subjacent riser.

Decorative pre-finished riser plates 12, with mitred ends 12', are provided for the risers 10 of each step 6 and are bonded thereto by a suitable adhesive diagrammatically indicated by glue beads 14. Decorative pre-finished tread plates 16 are provided for the treads 8. Each tread plate 16 has a decorative nosing 18 forming a front edge thereof and a plurality of spaced apart spikes members 20 extending horizontally inwardly beneath the tread plate from a lip 17 of the nosing 18 to a subjacent riser 10 with the tread plate 16 abuttingly covering the tread by insertion of the spike members through the adjacent riser plate 12 and into the adjacent riser 10 with the lip 17 abutting against the adjacent riser 10 and with the side edges of the tread plate 16 in register with the treads 8 and with the vertical surfaces 2*a*, 4*a* of the respective stringer boards 2, 4. In this example, at least one side edge of each tread plate 16 has a decorative nosing 19 since the tread plates are to be part of the open side of the staircase, no such edge nosing being required at the other edge since it will be located adjacent a bounding wall structure (not shown) of the relevant building.

On the open side of the staircase 1 as can be seen horizontal pre-drilled dowel holes 22 are formed in the vertical surface 2*a* of the stringer 2 with correspondingly located blind dowel holes 22' (see FIG. 3) being formed on the hidden side of the pre-finished stringer plate 40. Dowels 23 are provided for accurate positioning of the pre-finished stringer plate 40 relative to the corresponding stringer 2 by positive and frictional engagement in the aligned dowel holes 22 and their counterparts 22' in the plate 30.

Each tread 8 adjacent each side edge thereof is pre-drilled with pocket holes 33 which extend into and through the respective stringer board 2, 4 as can be seen at 33*a*.

On the open side of the staircase 1 a prefabricated decorative stringer plate 40 is provided and as shown essentially replicates the form of the stringer board 2 to which it is attachable by the dowels 23 registering with the holes 22 and their blind counterparts 22' (see FIG. 3) in the hidden side of the plate 40, the pocket hole screws (not shown). The riser edges 41 of the plate 40 are mitered as at 41'.

Figure 1:
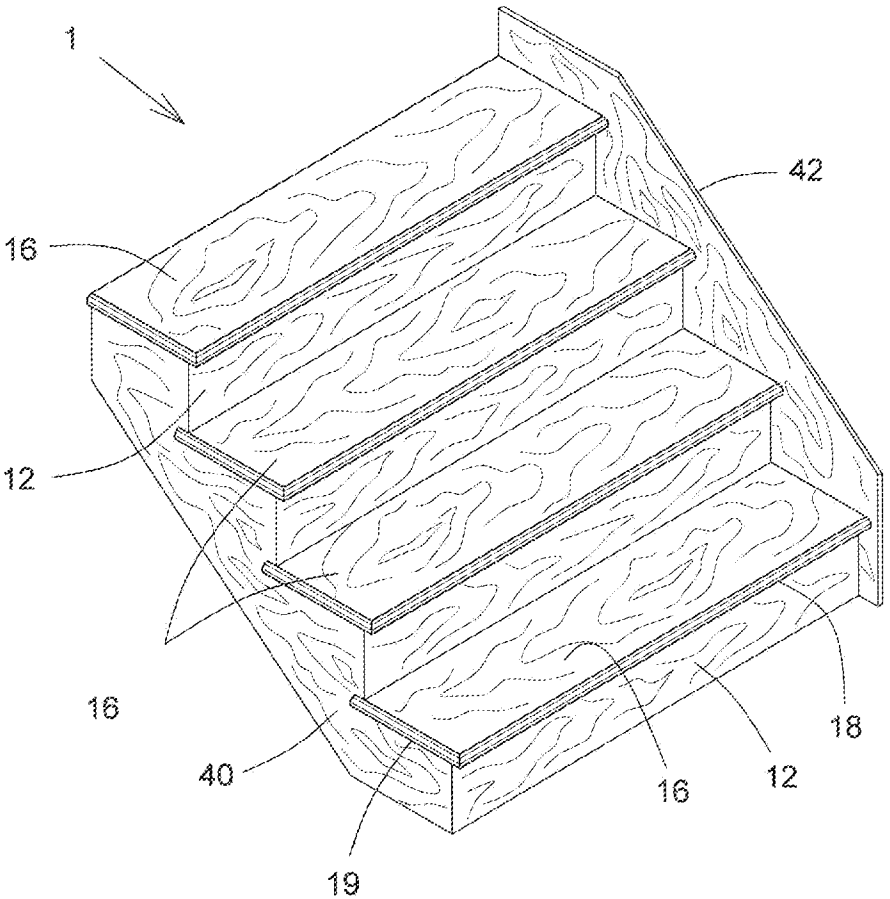
FIG. 1 is a top perspective view of a staircase incorporating a finishing plate arrangement in accordance with an embodiment of the present invention.

On the closed side of the staircase 1, a prefabricated stringer plate 42 is provided and may also have pre-drilled dowel holes (not shown) if it is applicable for its installation, the plate 42 being of quasi-trapezoidal shape such that in situ it covers in and thus closes the other side of the staircase 1 (see FIG. 1). Typically, such a stringer plate 42, on a closed side of the staircase 1, is slidably inserted into a corresponding opening left between the staircase and the rough adjacent wall.

Figure 5:
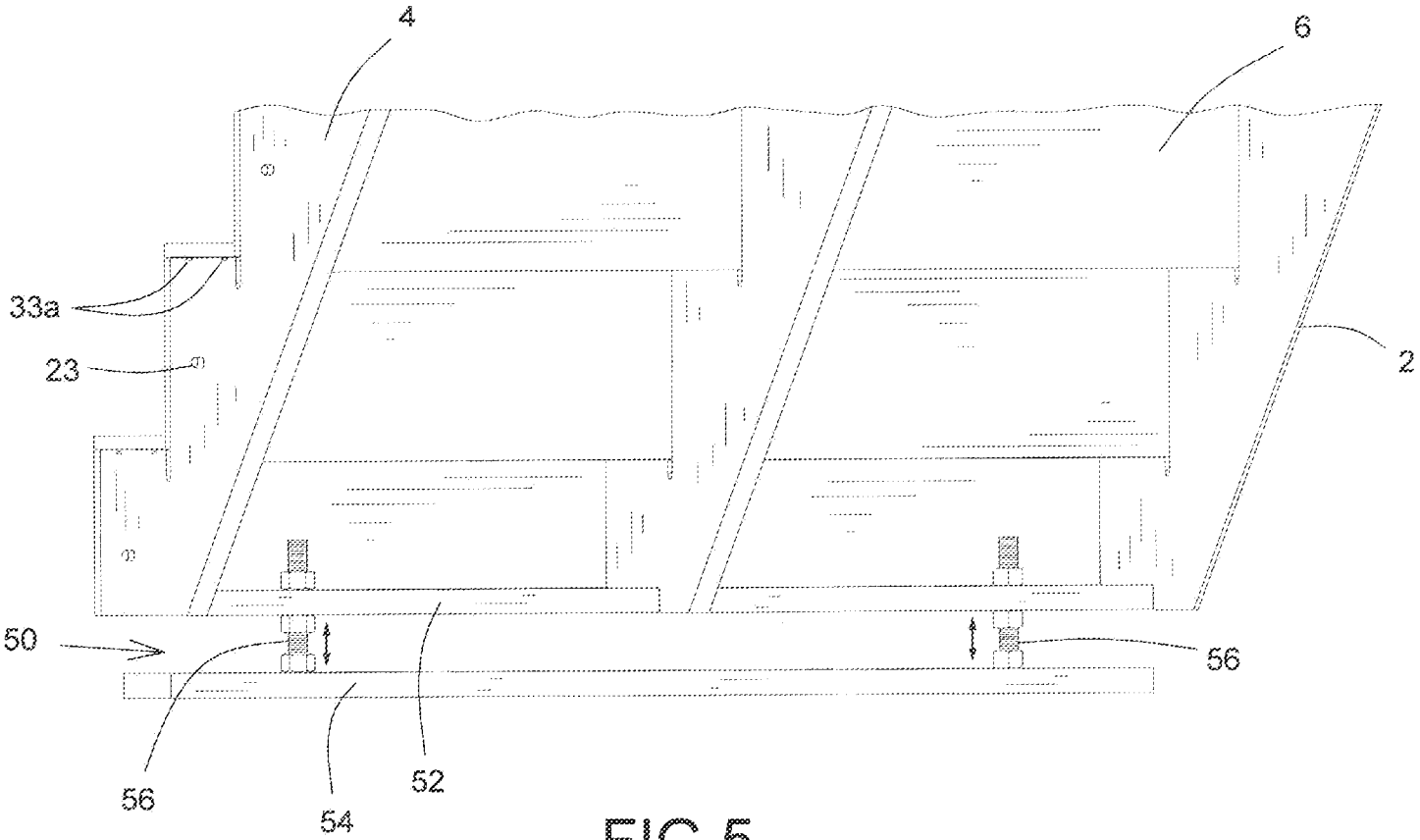
FIG. 5 is a scrap underside view of the staircase showing the mounting thereof to a floor structure of a building.

The installation of the skeleton of the staircase 1 is achieved in conventional manner and as can be seen from FIG. 5, the base 50 thereof is provided with a foot plate 52 for placement on a floor 54 with suitable bolting arrangements 56 being provided. As can be seen from this FIG. 5, the bolting arrangements 56 are adjustable thus facilitating leveling. The riser plates 12 are then applied to the risers 6 as previously indicated and bonded thereto be suitable glue. The stringer plates 40, 42 are then affixed to the respective stringer boards 2, 4 with the use of the dowels 23 and the use of pocket screws (now shown) driven through the treads 8, the stringer boards 2, 4 and into the plates 40, 42.

Figure 4:
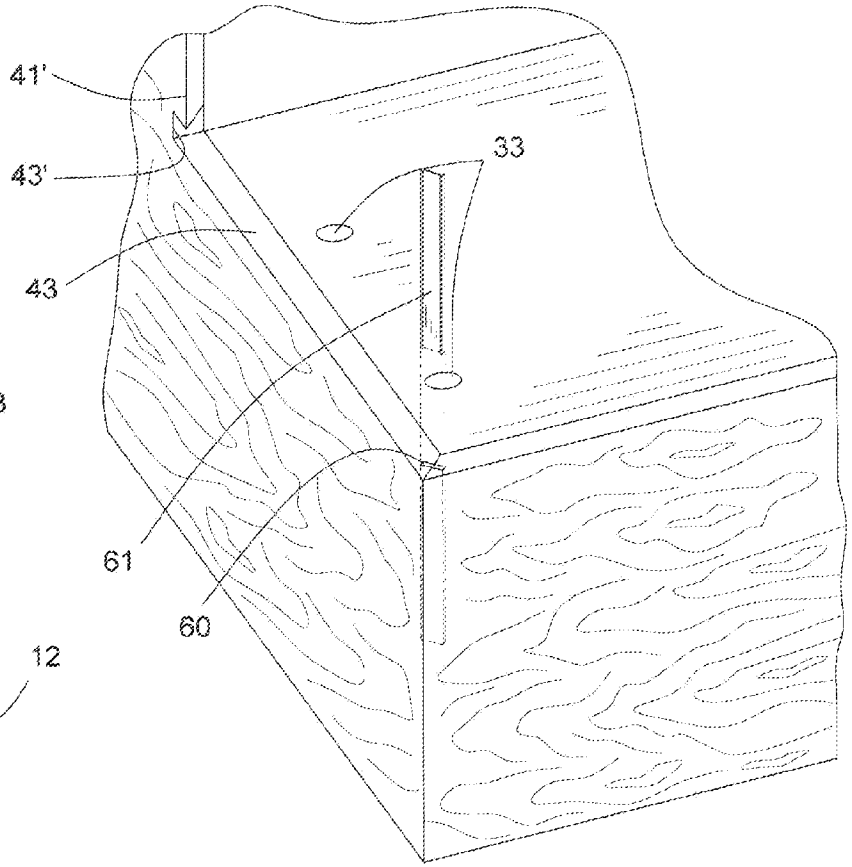
FIG. 4 is a perspective view of the detail of the fixture of FIG. 3 showing the fixture aligned for application.
Figure 3:
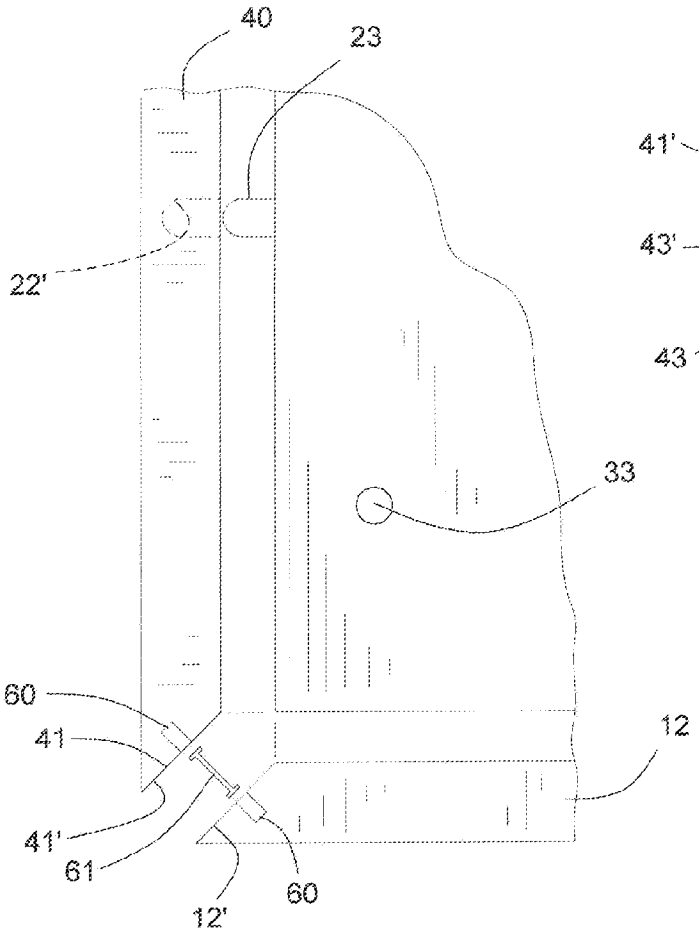
FIG. 3 is an exploded plan view of a detail of a fixture shown in FIG. 1.

The mitres 12' on the lateral edges of the riser plates 12 and the mitres 41' on the vertical edges 41 of the stringer plate 40 register with one another and as can be seen from FIGS. 3 and 4 are provided with slots 60 extending part way along their length. When the mitres are fully touching the slots 60 align and securing nails 61 as seen are slidably inserted, as by hammering, in a direction along the respective lateral edge and vertical edge 41 (in a direction parallel to a plane defined by respective plates 12, 40), in frictional manner further to secure the plate 40, which prevents the riser plates 12 from sliding relative to the stringer plate 40 and ensures a nice assembly finish (securing nail 61 hidden from outside—not seen by users). A similar fixture arrangement is provided for the plate 42 in respect of the final, bottom step.

Finally, the tread plates 16 are applied to the treads 8 and essentially are slid onto the treads and forced into position with the spike members 20 penetrating the riser plates and the risers 10 and the riser plates 12, the decorative side nosing 20 overhanging the plate 40 as seen in FIG. 1. As better seen in FIGS. 2 and 4, each horizontal edge 43 of the stringer plate 40 extends inwardly from a superjacent vertical edge 41 and forms a corresponding tread slot 43' to allow the respective tread plate 16 to intersect the superjacent vertical plate edge 41' and have the tread plate 16 locally sandwiched between the stringer plate 40 and the corresponding superjacent riser plate 12.

Figure 6:
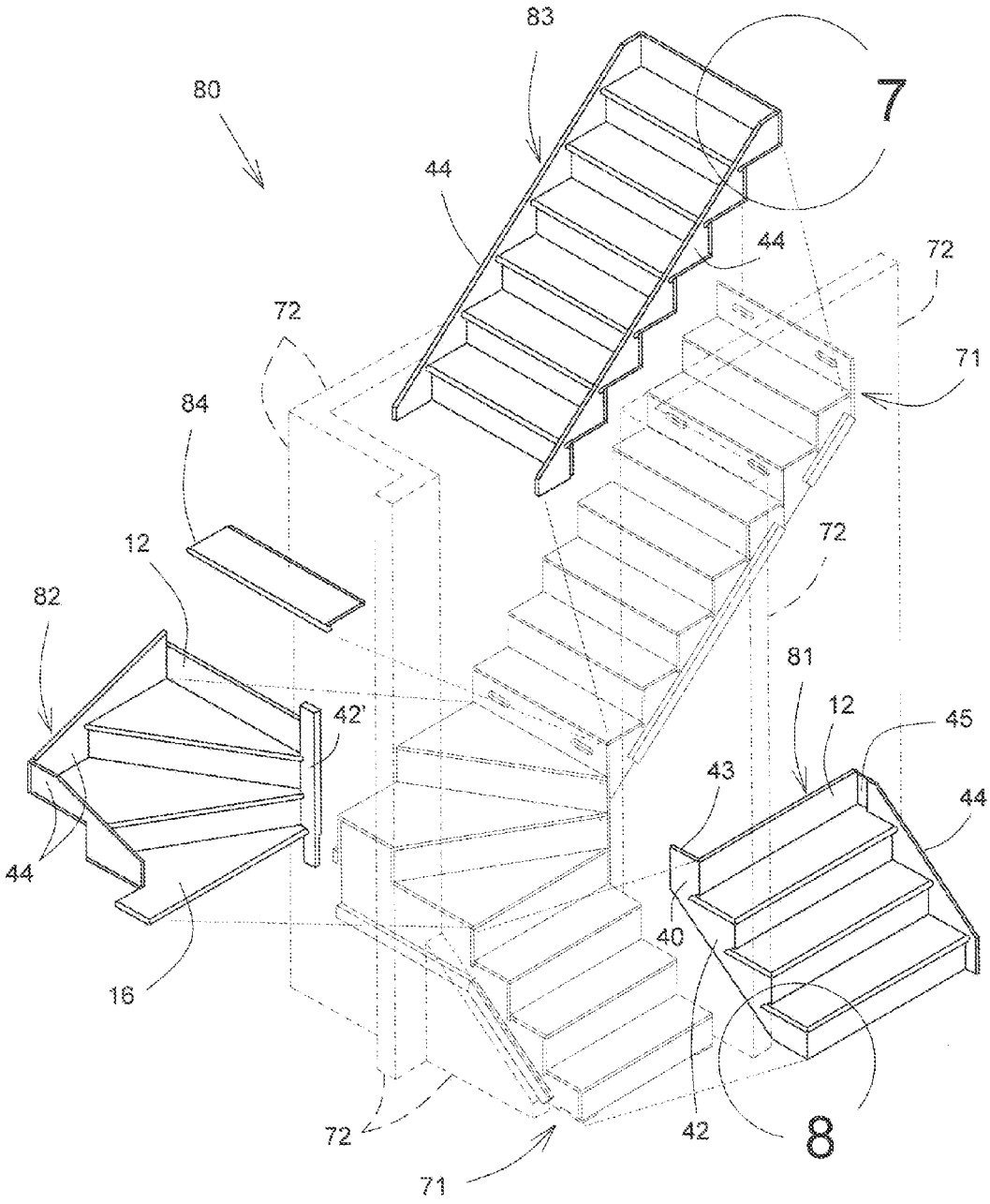
FIG. 6 is a top perspective exploded view of a staircase incorporating a finishing plate arrangement in accordance with another embodiment of the present invention, with the finishing plates being preassembled together prior to mounting onto at least a portion of the prefabricated staircase frame.
Figure 7:
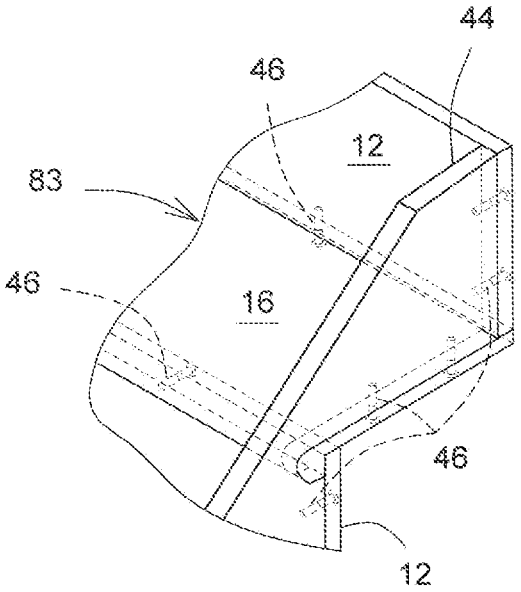
FIGS. 7 and 8 are enlarged sectioned view taken along lines 7 and 8, respectively, showing attachment details of the different plates.
Figure 8:
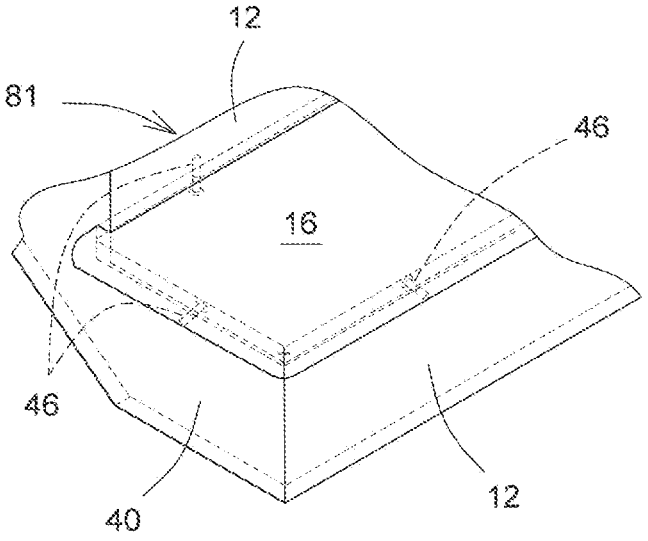

Referring now more specifically to FIGS. 6 to 8, there is shown another embodiment of a finishing plate arrangement 80, or kit, that is preassembled, or factory assembled, into three lower 81, middle 82 and upper 83 sections, plus a joining tread plate 84 between the middle and upper sections 82, 83. The arrangement 80 is adapted to mount over the prefabricated staircase frame 71 surrounded by an adjacent bounding wall structure 72 of the relevant building shown in stippled lines with the exception of one side of the lower section 81 and the lowest tread plate 16 of the middle section 82 which is open.

To install the three sections 81, 82, 83, the lowest one 81 has to be installed first since the bottom portion of the superjacent section 82 generally slides over the top portion of the subjacent section 81. In the present embodiment, the decorative front nosing 18 of the lowest tread plate 16 of the middle section 82 abuttingly covers to top edge of the uppermost riser plate 12 of the lower section 81 and the corresponding horizontal edge 43 of the stringer plate 40. Furthermore, the downwardly protruding staircase inner corner stringer plate of the middle section 82, represented here by a stringer post 42 or the like (since the middle section 82 is a 90-degree angle section), also slides inside a corresponding recess 45 made into the closed side stringer plate 44 of the lower section 81 for better securing the two sections 81, 82 to one another.

Similarly, for ease of assembly in installing the upper section 83, the lowest tread plate thereof, or an intermediate tread plate 84, is installed at the end to properly abuttingly cover the uppermost riser plate 12 and the stringer post 42'. Although not specifically shown, the installation of each section 81, 82, 83, 84 onto a corresponding portion of the prefabricated staircase frame 71 could be done using any suitable chemical and/or mechanical securing means such as adhesive, screws and the like.

In this arrangement 80, the stringer finishing plates 44 abutting against an adjacent wall structure 72 are adapted to abut the exposed front and top finished surfaces of the corresponding riser and tread plates 12, 16 for attachment thereto via securing screws 46 from the back and undersides of the plates 12, 16, respectively, as shown in FIGS. 7 and 8. In addition, adjacent riser and tread plates 12, 16 are also secured to one another with a plurality of securing screws 46 or the like attachment means. Typically, predrilled holes are provided at the different locations to ensure proper registration of the adjacent plates 12, 16, 40, 42', 44 and prevent damaging thereof with the screws 46 while being inserted.

Although not shown in FIGS. 6 and 8, slots with corresponding Chinese nails or the like could also be used to better frictionally secure the corresponding mitred edges of the stringer plate 40 and the corresponding riser edges, as shown in FIG. 4.

In the different embodiments of the present invention, the prefabricated staircase frame 1, 71 may also be part thereof, especially as they could be sold into a whole complete staircase kit, including the rough frame and the corresponding finishing plates.

The present invention thus provides a staircase of relatively simple skeletal construction with the added aesthetic cladding provided by the easy-to-apply prefabricated decorative plates to cover the treads, the risers and the stringers of the staircase skeleton, which may thus be produced from relatively unfinished wood. Furthermore, the staircase may be installed with minimal skills in the absence of any requirement to cut wood to size since all elements are prefabricated and pre-drilled as needed.

The present invention also refers to a corresponding method for installing a prefabricated staircase 1, the method comprising the steps of:

connecting generally opposed frame ends of a prefabricated staircase frame 1 to first and second floor structures of a building with the frame 1 extending between the first and second floor structures. The frame 1 has at least one vertical riser 10, at least one horizontal tread 8, and at least one stringer board 2 to which each said at least one vertical riser 10 and each said at least one vertical tread 8 are connected. The frame 1 is connected at the opposing frame ends to the first and second floor structures; and after connecting the generally opposed frame ends, connecting at least one preassembled finishing plate arrangement 80 to at least a portion of the prefabricated staircase frame 1.

The preassembled finishing plate arrangement 80 typically includes at least one prefabricated finished stringer plate 40, at least one prefabricated finished riser plate 12 and at least one prefabricated finished tread plate 16. The step of connecting the at least one preassembled finishing plate arrangement 80 includes:

after connecting the generally opposed frame ends, for each stringer board 2, connecting a respective prefabricated finished stringer plate 40 therefore to the stringer board 2 to cover the stringer board 2 with, for each tread 8, a respective horizontal plate edge 43 of the stringer plate 40 in horizontal alignment with the tread 8, and, for each riser 10, a respective vertical plate edge 41 in vertical alignment with the riser 10;

after connecting each stringer plate 40, for each riser 10, connecting a respective prefabricated finished riser plate 12 to abuttingly cover the riser 10 with a top horizontal edge of the riser plate 12 in horizontal alignment with an adjacent tread 8 and the respective horizontal plate edge 43 and intersecting an adjacent vertical plate edge 41; and after connecting a respective prefabricated riser plate 12, for each tread 8, connecting a prefabricated finished tread plate 16, having a decorative nosing 18 forming at least a front edge thereof, to an adjacent riser 10 with the tread plate 16 abuttingly covering the tread 8 by abutment against the adjacent riser plate 12 with a lip 17 of the nosing 18 and with side edges of the tread plate 16 in alignment with the horizontal plate edge 43.

I claim:

1. A method for installing a prefabricated staircase, the method comprising the steps of:

connecting generally opposed frame ends of a prefabricated staircase frame to first and second floor structures of a building with the frame extending between the first and second floor structures, the frame having at least one vertical riser, at least one horizontal tread, and at least one stringer board to which each said at least one vertical riser and each said at least one horizontal tread are connected, the frame connected at said opposed frame ends to the first and second floor structures;

preassembling at least one preassembled finishing plate arrangement by connecting at least one prefabricated finished stringer plate to at least one prefabricated finished riser plate and to at least one prefabricated finished tread plate, the at least one prefabricated finished riser plate connecting to the at least one prefabricated finished tread plate; and after the steps of connecting the generally opposed frame ends and preassembling at least one preassembled finishing plate arrangement, connecting the at least one preassembled finishing plate arrangement to at least a portion of the prefabricated staircase frame;

wherein the at least one preassembled finishing plate arrangement includes lower and upper preassembled finishing plate sections connecting to an adjacent one said at least a portion of the prefabricated staircase frame, each said lower and upper preassembled finishing plate section including at least one prefabricated finished stringer plate, at least one prefabricated finished riser plate and at least one prefabricated finished tread plate, the step of connecting the at least one preassembled finishing plate arrangement including:

for each said lower and upper preassembled finishing plate section, connecting, said at least one prefabricated finished tread plate onto and covering the at least one horizontal tread with said at least one prefabricated finished riser plate in covering alignment with an adjacent said at least one vertical riser and with said at least one prefabricated finished stringer plate in covering alignment with an adjacent said at least one stringer board; and connecting a lowermost of said at east one prefabricated finished riser plate or of said at least one prefabricated finished tread plate of said upper preassembled finishing plate section in alignment with, respectively, and adjacent uppermost of said at least one refabricated finished tread plate or of said at least one prefabricated finished riser plate of said lower reassembled finishing plate section;

wherein the upper preassembled finishing plate section is a corner section connecting to a corner portion of the prefabricated staircase frame and includes an inner corner finished stringer plate, said inner corner finished stringer plate having a protrusion downwardly extending therefrom, the step of connecting the at least one preassembled finishing plate arrangement further including connecting said protrusion of said inner corner finished stringer plate of said upper preassembled finishing plate section into a recess extending into an adjacent one said at least one said at least one prefabricated finished stringer plate of said lower preassembled finishing plate section.

2. The method of claim 1, wherein the at least one preassembled finishing plate arrangement further includes an intermediate tread plate connecting to an adjacent one said at least a portion of the prefabricated staircase frame, the step of connecting the at least one preassembled finishing plate arrangement including:

connecting said intermediate tread plate onto and covering one said at least one horizontal tread, with said intermediate tread plate connecting in alignment with an adjacent lowermost said prefabricated finished riser plate of said upper preassembled finishing plate section and an adjacent uppermost said prefabricated finished riser plate of said lower preassembled finishing plate section.

* * * * *